US005239847A

United States Patent [19]

Lee

[11] Patent Number: 5,239,847

[45] Date of Patent: Aug. 31, 1993

[54] AGITATOR FOR A WASHING MACHINE

[75] Inventor: Kyu-Chai Lee, Suwon, Rep. of Korea

[73] Assignee: Samsung Electronics Co., Ltd., Suweon, Rep. of Korea

[21] Appl. No.: 894,939

[22] Filed: Jun. 8, 1992

[30] Foreign Application Priority Data

Jun. 12, 1991 [KR] Rep. of Korea ..... 91-8683[U]

[51] Int. Cl.[5] ..... D06F 37/00

[52] U.S. Cl. ..... 68/134; 366/317; 416/242

[58] Field of Search ..... 68/133, 134; 366/315, 366/314, 317; 416/231 A, 242 A

[56] References Cited

U.S. PATENT DOCUMENTS

| | | | |
|---|---|---|---|
| 2,358,205 | 9/1944 | Blough | 68/134 |
| 2,495,999 | 1/1950 | Brook | 68/134 |
| 2,741,905 | 4/1956 | Petersen | 68/134 |
| 3,172,645 | 3/1965 | Price, Jr. | 68/134 X |
| 3,464,239 | 9/1969 | Hubbard et al. | 68/134 |

FOREIGN PATENT DOCUMENTS

| | | | |
|---|---|---|---|
| 1219088 | 12/1959 | France | 68/134 |
| 59-148780 | 4/1984 | Japan . | |
| 59-91995 | 5/1984 | Japan | 68/134 |
| 5080293 | 5/1984 | Japan | 68/134 |
| 59-119286 | 11/1984 | Japan . | |
| 1-268592 | 10/1989 | Japan | 68/134 |
| 223751 | 11/1968 | U.S.S.R. | 68/134 |
| 785462 | 10/1957 | United Kingdom | 68/134 |

*Primary Examiner*—Frankie L. Stinson
*Attorney, Agent, or Firm*—Burns, Doane, Swecker & Mathis

[57] ABSTRACT

An agitator for a clothes washer includes a base and a plurality of blades projecting generally radially outwardly along the base. Each blade, which is of generally S-shape as viewed in plan, includes first and second sides which are of mutually different inclinations with respect to vertical. The first side is of steeper inclination than the second side along a radially inner portion of the blade, and is of less steep inclination than the second side along a radially outer portion of the blade. As viewed in plan, each blade is generally convexly shaped along its radially inner portion and generally concavely shaped along its radially outer portion.

1 Claim, 3 Drawing Sheets

AGITATOR FOR A WASHING MACHINE

BACKGROUND OF THE INVENTION

1. Field of the Invention

The present invention relates to a washing machine (hereinafter referred to as "washer"), and more particularly to an agitator of a washer.

2. Description of the Prior Art

Generally, an agitator-type washer is designed to wash laundry by oscillating deftly the agitator in forward and reverse directions, and various kinds of agitators used in the agitator-type washer have been proposed for the improvement of washing efficiency.

For example, Japanese laid open Utility Mode application No. Sho 59(1984)-119286 entitled, "Stirring Blades for Washer" discloses that the stirring blade has a semi-spherical shape rising toward the peripheral rim, and at the same time, has a horizontal surface descending outwardly from the semi-spherical shape. The stirring blade also has a curved base soaring up toward the peripheral rim and on this base there are provided plural pieces of radiating and extended protrusions, between which thin ribs are formed.

Also, Japanese laid open Utility application, Sho 59-148780 entitled "Stirring blades for washer" discloses that the stirring blade has a protrusion having a spherical curve in the center, from which the blade runs descending to the lower area of base, from which the base rises toward the peripheral rim. And on this base, there form solid or solidly-shaped plural protrusions, between which water outlets are formed.

However, this kind of conventional technical construction has a problem of deteriorated washing efficiency due to poor agitation in the up-down vertical condition (i.e., parallel condition with the stirring blades) though the agitation is obtained in a degree with the water in horizontal condition due to the plural stirring blades being protruded vertically from the peripheral rim of the base plate.

SUMMARY OF THE INVENTION

Accordingly, it is the object of the present invention to provide the agitator of a washer which can improve washing efficiency by causing the up-down vertical agitating operation of the laundry to be effected smoothly.

It is another object of the present invention to provide the agitator of a washer which has increased washing efficiency by imparting instantaneous impact to the laundry rising up along the slopes of the agitator stirring blades, and at the same time by preventing the laundry from floating up instantly to the surface of the water.

The agitator of a washer in accordance with the present invention for achieving above-mentioned objects is provided with the base plate of the agitator being formed concave from the center to the peripheral rim, and with the slant face of the stirring blades formed on said base plate to be caused to have different angle of inclination against the facing sides, and with the upper area contacting the said slant face of different angles of inclination to be caused to have curved form, thereby making smooth the movement of the water and laundry from the inward to the outward by virtue of the stirring blades having different angles of inclination, and also thereafter increasing the washing efficiency as well by the water and laundry being put instantaneous impact from the slant face of the agitator having shaper inclination for increased friction force or turbulence.

BRIEF DESCRIPTION OF THE DRAWINGS

For better understanding of the nature and objects of the invention, reference should be made to the following detailed description taken in connection with the accompanying drawings in which:

FIGS. 4A and 4B are sectional views taken through a stirring blade in each of FIGS. 2 and 3, wherein FIG. 4A is a sectional view taken along each of lines A—A and FIG. 4B is a sectional view taken along each of lines B—B.

DETAILED DESCRIPTION OF THE INVENTION

With reference to the attached drawings, the agitator of a washer in accordance with the present invention is explained in detail as follows.

Figure 1:
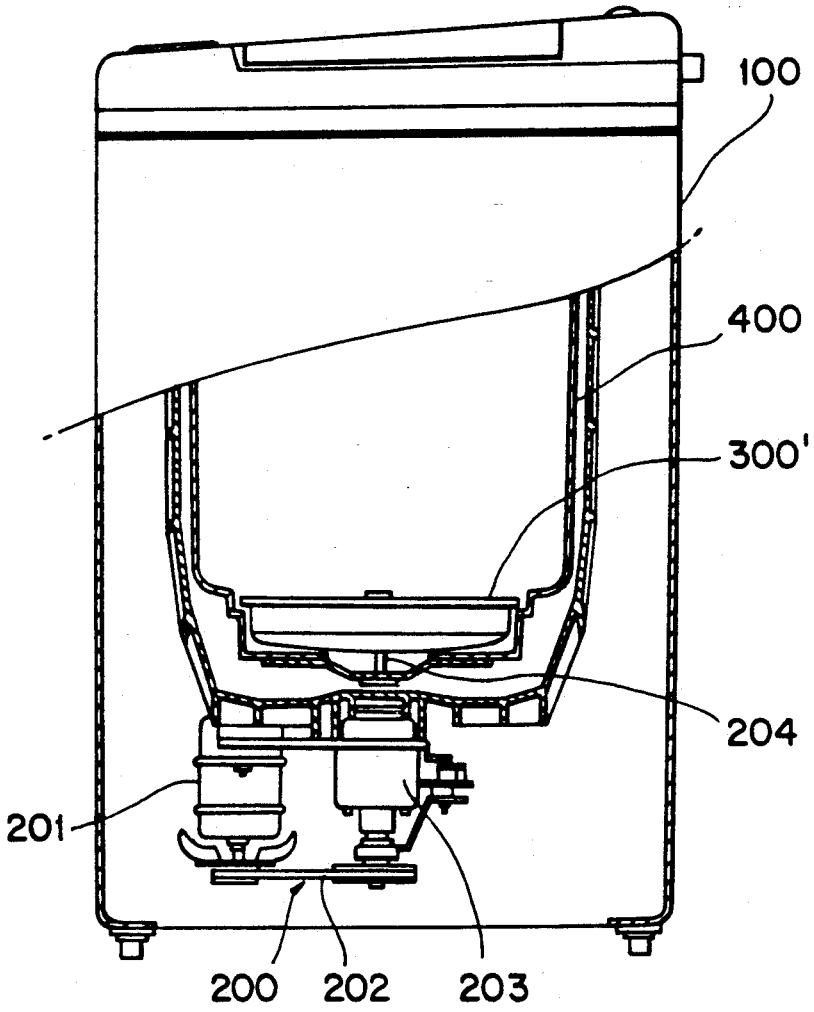
FIG. 1 (PRIOR ART)
FIG. 1 is a partially cut-open lateral view of conventional washer.

FIG. 1 is a partially cut-open lateral view to show the construction of a conventional washer, wherein 100 is a washer main body, 200 is driving part generating the power necessary for washing, 300 is an agitator rotating in the right and reverse directions upon the driving force generated from said driving part 200, and 400 is a tub.

The driving part 200 is the said construction includes a power-generating motor 201, a clutch 203 which discontinues the power of said motor 201 transmitted through a pulley 202, and a power axis 204 which transmits the power of the motor to the agitator 300 or to the bus 400.

Therefore, when the washer is operated after the laundry is tossed into the tub 400, the motor 201 is operated by a control program or data set by the user, and the power of motor 201 is transmitted to the clutch 203 by way of the pulley 202.

The clutch 203 transmits the power of the motor 201 transferred through the pulley 202 in accordance with the washing or spin drying and the like to the agitator 300 or to the tub 400 through the power axis.

In other words, during the washing process, the clutch is operated for transmitting the power of the driving part 200 to the agitator 300 and at the initial stage of washing, the driving part 200 measures the amount of the laundry by oscillating the agitator in the right and left directions.

When the amount of the laundry is measured, the tap water is supplied by the tap (not shown) according to the amount of the laundry, and the driving part 200 oscillating the agitator in the right and left directions. The friction force or turbulence generated by the left-right oscillation of the agitator 300 in between the soapy water, laundry, agitator 300 and the tub 400 performs the washing.

The clutch 203, during the spin cycle, transmits the power of the motor 201 to the tub 400 and rotates the tub in high revolution for performance of spin drying.

Of course, before the spin cycle, draining is performed.

The conventional washer so operated in the said operating principles performs repeatedly once or up to several times the water supply, washing, draining, spin cycle and rinsing procedures in accordance with a control program, the user's setting data or the amount of the laundry.

Figure 2:
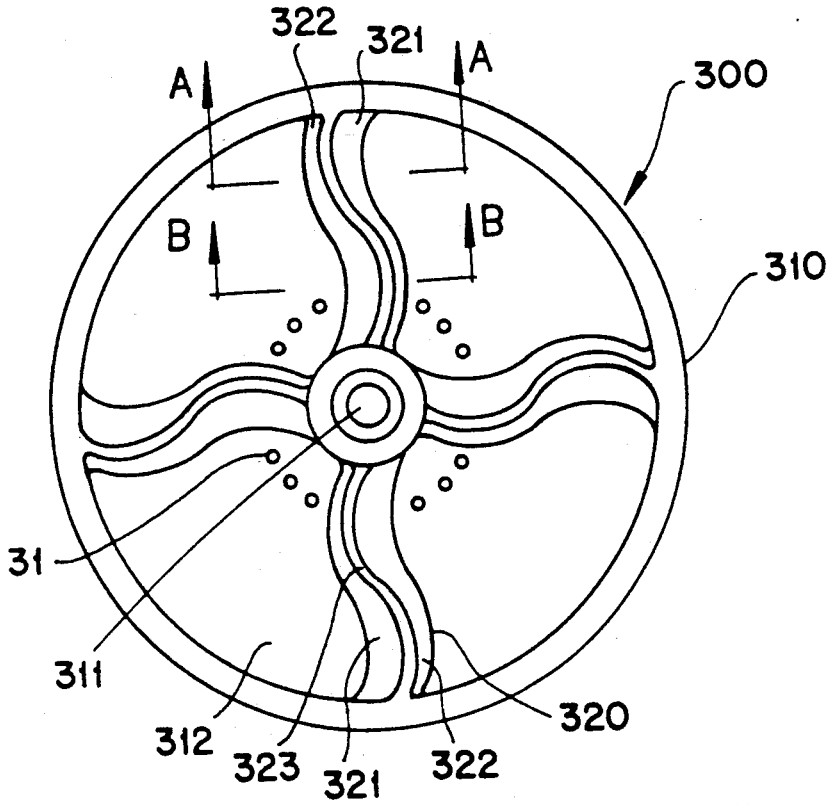
FIG. 2 is a plane of an embodiment for an agitator of washer in accordance with the present invention.

FIG. 2 is a plan view of an embodiment for an agitator of a washer in accordance with the present invention, wherein 310 is a base plate constituting overall shape of the agitator 300 being formed of upwardly open recess shape, e.g., of concave shape from the center toward the agitator, 320 are plural stirring blades having upstanding slides 321, 322 forming different angles of inclination to vertically (compare FIGS. 4A and 4B) to increase washing efficiency by smooth agitation between laundry and water, and increase of friction force of laundry.

The base plate 310 so constructed as above includes locking groove 311 formed in the center for locking into the power axis of the driving part, a collecting basin 312 curved downwardly toward the peripheral rim for holding water, and a discharge outlet 313 for discharging residual soapy water contained in said collecting basin 312.

The top surface 323 of each stirring blade 320 is viewed from above roughly as an S-shape.

In other words, the agitator 300 is formed with a locking groove 311 in the center axis of disc-shaped base plate, and from this locking groove 311 a collecting basin 312 is formed downwardly and toward the outside peripheral rim. The stirring blade 320 protrudes upwardly from the concaved collecting bass in 312 and has first and second sides or slant faces 321, 322 having mutually different angles of inclusion relative to vertical. These first and second slant faces form an "S"-shaped top curved area 323. The stirring blades 320 are facing each other, being formed around the locking groove 311 as several "S" shaped pieces.

Figure 3:
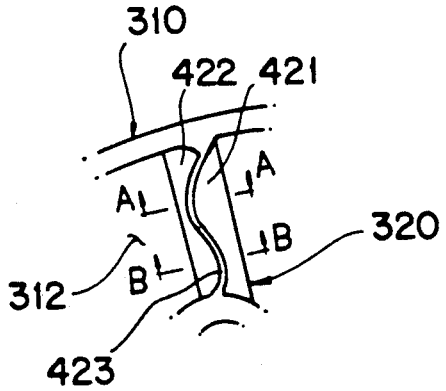
FIG. 3 is a plan view of another embodiment of an agitator of washer in accordance with the present invention.

Accordingly, during the agitator 300 being rotated clockwise as viewed in FIG. 3, the laundry and soapy water are caused to move generally radially outwardly from a steep angled portion of first slant face (or incline, or slope) 321 (see FIG. 4B) to a gentle slope portion of face 321 (see FIG. 4A), i.e., as the laundry and water move from the side of the agitator. As the gentle slope has a concave shape, causing the laundry and water to get agitated, the laundry and water steep slope area get moved in a whirling direction.

Figure 4A:
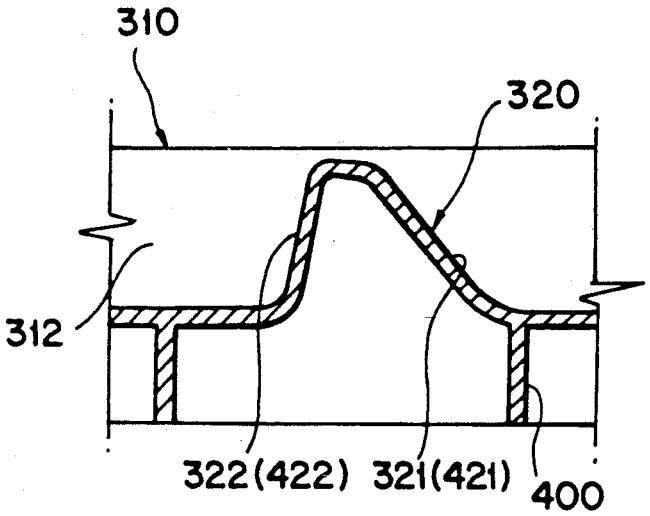
Figure 4B:
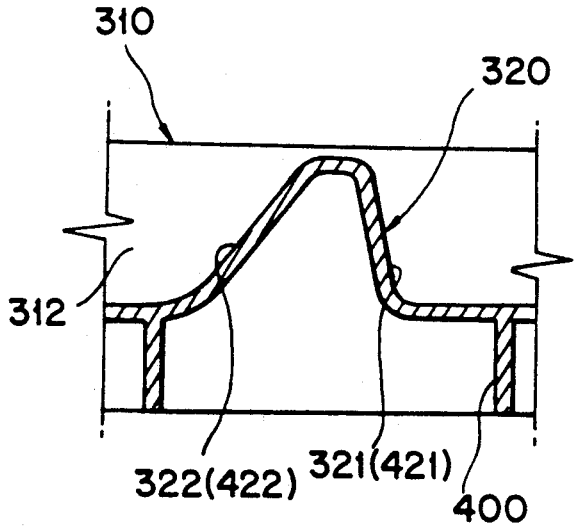

Furthermore, during the counter-clockwise rotation of the agitator 300, the laundry and water moved generally radially upwardly from a steep slope portion of second slant face 322 (see FIG. 4A) to a gentle portion thereof as shown in FIG. 4B (i.e., as the laundry and water are from the peripheral rim to the locking groove).

As the gentle slope has a concave shape when viewed from above, thereby resulting in the laundry and water to be agitated, and causing the laundry and water to get moved in a whirling direction the effect of increasing the washing efficiency can be obtained.

Here, in consideration of centrifugal forced by the turning effect of the agitator, if the change for angle of inclination at second slant face is made bigger than that of first slant face, more effective result can be achieved in the movement of laundry from the peripheral rim to the inner area (i.e., to the locking groove) during counter-clockwise rotation of the agitator.

FIG. 3 is a plan view of another embodiment of an agitator of a water in accordance with the present invention, however for convenience sake, only part of the embodiment is shown.

In the FIG. 3, the agitator 320 includes first and second slant faces 421, 422 rising upward and having different angles of inclination from the locking groove 311 (FIG. 4B) of the base plate 310 to the peripheral rim (FIG. 4A) through the concave collecting basin 312, and an S-shaped curved top surface 423 formed between the first and second slant faces 421, 422.

Here, the line of contact formed at the junction of the collecting basin 321 of the base plate 310 and each of the first and second slant faces 421, 422 of the stirring blade 320 is a straight line as viewed in plan. The first slant face 421 gradually form a gently angle of inclination (FIG. 4A) from a steep angle of inclination (FIG. 4B) as the peripheral rim is approached. The second slant face 422 meanwhile forms a steep angle of inclination (FIG. 4A) from the gentle angle of inclination (FIG. 4B) as the locking groove 311 is approached.

FIG. 4A and 4B are sectional views showing the construction of the stirring blade embodiments shown in FIG. 2 and FIG. 3, respectively wherein FIG. 4A which is taken at a location near the peripheral rim illustrates the first slant face 321 or 421 of the stirring blase 320 has a gentle slope and second slant face 322 or 422 forms a steep slope at that location.

In the sectional view (B—B) taken near the locking grove, first slant face 321 or 421 of the stirring blade has a steep slope and second slant face 322 or 422 has a gentle slope.

In FIG. 4A and FIG. 4B, 400 is a reinforcement rib which supports rotating base plate 310 and respective stirring blades.

As illustrated in the foregoing, the stirring blades of the agitator in accordance with the present invention have different slopes and are give curved shape as viewed in plan, making it possible for the laundry and water to be easily moved radially between the inner area and the outer area during the agitator being rotated clockwise and counter clockwise. And at the same time, due to the steep slope of the stirring blades, the effect of washing efficiency is enhanced as the friction force or turbulence is increased by the whirling motion of laundry and water.

Furthermore, because the laundry and water are smoothly moved from the inner area to the outer area, the laundry is prevented from floating up to the surface.

Although the invention has been described in detail with reference to its presently-preferred embodiment, it will be understood that various modifications can be made, without departing from the spirit and scope of the invention.

What is claimed is:

1. An oscillatory agitator for a clothes washer having at least two stirring blades fanning out from a center of the agitator, each blade having first and second side surfaces facing in opposite directions of the oscillatory movement of the agitator, each of said blades being generally S-shaped as viewed in plan such that a radially inner portion of each blade includes a concave section on said second side surface and a convex section on said first side surface, and a radially outer portion of each blade includes in a concave section on said first side surface and a convex section on said second side surface, each of said side surfaces being inclined relative to vertical and being of less steep inclination along its concave section than along its convex section.

* * * * *